US005471362A

United States Patent [19]

Gowan

[11] Patent Number: 5,471,362

[45] Date of Patent: Nov. 28, 1995

[54] CORONA ARC CIRCUIT

[75] Inventor: Thomas L. Gowan, South Jamesport, N.Y.

[73] Assignee: Frederick Cowan & Company, Inc., Riverhead, N.Y.

[21] Appl. No.: 23,371

[22] Filed: Feb. 26, 1993

[51] Int. Cl.[6] ..... F23Q 5/00

[52] U.S. Cl. ..... 361/257; 123/620; 123/598

[58] Field of Search ..... 361/247, 251, 361/253, 256, 257, 263; 123/598, 620; 315/209 CD

[56] References Cited

U.S. PATENT DOCUMENTS

| | | | |
|---|---|---|---|
| 3,584,929 | 6/1971 | Schuette | 361/257 |
| 3,629,652 | 12/1971 | Maycock | 361/257 |
| 3,646,922 | 3/1972 | Spalding | 123/407 |
| 3,974,412 | 8/1976 | Pratt, Jr. | 313/131 R |
| 4,033,316 | 7/1977 | Birchenough | 123/598 |
| 4,122,816 | 10/1978 | Fitzgerald et al. | 123/598 |
| 4,124,003 | 11/1978 | Abe et al. | 123/536 |
| 4,129,895 | 12/1978 | Witting | 361/257 |
| 4,301,782 | 11/1981 | Wainwright | 315/209 CD |
| 4,327,701 | 5/1982 | Gerry | 123/598 |
| 4,369,758 | 1/1983 | Endo | 123/620 |
| 4,457,285 | 7/1984 | Hamai et al. | 123/598 |
| 4,510,915 | 4/1985 | Ishikawa et al. | 123/620 |
| 4,672,928 | 6/1987 | Hartig | 123/143 B |
| 4,677,960 | 7/1987 | Ward | 123/598 |
| 4,839,772 | 3/1988 | Choi et al. | 361/256 |
| 4,969,432 | 11/1990 | Scharnweber et al. | 123/143 B |
| 4,998,526 | 3/1991 | Gokhale | 123/598 |
| 5,179,928 | 1/1993 | Cour et al. | 123/598 |

*Primary Examiner*—William M. Shoop, Jr.
*Assistant Examiner*—Peter Ganjoo
*Attorney, Agent, or Firm*—Scully, Scott, Murphy & Presser

[57] ABSTRACT

A corona arc circuit has a spark plug connected in series with a rectifier. A capacitor is connected in series with a spark gap and the spark plug. An electrical power source has a transformer with a primary winding providing an AC voltage and a secondary winding connected to the capacitor via the rectifier for charging the capacitor. The secondary winding is connected to the spark plug via a high voltage diode thereby providing a current path for the spark gap at a predetermined voltage and simultaneously discharging the capacitor through the spark plug via the spark gap without short-circuiting the spark gap.

2 Claims, 4 Drawing Sheets

CORONA ARC CIRCUIT

BACKGROUND OF THE INVENTION

The present invention relates to a corona arc circuit. More particularly, the invention relates to a corona arc circuit which is compatible with a conventional spark plug.

A high energy ignition system or power arc ignitor is typically used to ignite extremely dirty fuels. A normal 5 to 10 thousand volt high voltage transformer will not function when the fuel is extremely dirty, because the available current is too low to avoid being short-circuited by contaminants, or by the fuel itself, when such fuel is a heavy residual oil, commonly known as "Number 6". Furthermore, power arc ignitors of the prior art utilize a special low resistance spark plug which is constructed with a semiconductor component.

The principal object of the invention is to provide a corona arc circuit which utilizes a usual spark plug instead of the special low resistance spark plug now used.

An object of the invention is to provide a corona arc circuit of simple structure which ignites extremely dirty fuels as well as lightly contaminated fuels.

Another object of the invention is to provide a corona arc circuit of simple structure which functions efficiently, effectively and reliably to ignite lightly and highly contaminated fuels.

Still another object of the invention is to provide a corona arc circuit which is less expensive in manufacture and operation than presently used circuits of similar type.

BRIEF SUMMARY OF THE INVENTION

In accordance with the invention, a conventional 2000 volt capacitive discharge ignition circuit which requires a special semiconductive spark plug is augmented in a manner whereby it will function properly with a conventional spark plug.

In accordance with the invention, a corona arc circuit comprises an electrical power source having transformer means, the transformer means having a secondary winding. A spark plug is electrically connected in series with the secondary winding of the transformer means. A capacitor is electrically connected to the spark plug. A spark gap is electrically connected between the capacitor and the spark plug. The spark gap has a breakdown voltage. The capacitor applies a large electrical charge to the electrodes of the spark plug when the spark gap breaks down and substantially becomes a closed switch; the spark gap triggering a high energy ignition current when the capacitor voltage reaches the breakdown voltage of the spark gap and switching off the ignition current when the capacitor voltage drops below the breakdown voltage.

In accordance with the invention, a corona arc circuit comprises rectifier means. A spark plug is connected in series with the rectifier means. A spark gap is connected in series with a capacitor and the spark plug. High voltage diode means is provided. An electrical power source has transformer means, the transformer means has AC primary winding means and secondary winding means connected to the capacitor via the rectifier means for charging the capacitor and connected to the spark plug via the high voltage diode means. This provides a current path for the spark plug at a predetermined voltage and simultaneously discharges the capacitor through the spark plug via the spark gap.

In a first embodiment of the invention, the transformer means comprises two transformers each having a primary winding and a secondary winding.

In a first modification of the first embodiment of the invention, the transformer means comprises a single transformer having a single primary winding and two secondary windings having first and second ends.

In a second modification of the first embodiment of the invention, timing means is connected to the second ends of the secondary windings for timing the charging and discharging of the capacitor.

In a second embodiment of the invention, the transformer means comprises a single transformer having a primary winding and and secondary winding. The secondary winding is connected to the capacitor via the high voltage diode means and the rectifier means. The spark gap and the rectifier means are connected in parallel with each other.

In a modification of the second embodiment of the invention, an additional spark gap is connected in series with the high voltage diode means and the spark plug and connected in series with the spark plug, the spark gap and the capacitor for assuring the building up of the correct charge in the capacitor regardless of short-circuiting contaminants at the spark plug.

The corona arc circuit of the first embodiment of the invention comprises a first transformer having a primary winding and a secondary winding having a first end and a second end and providing a determined voltage. A second transformer has a primary winding and a secondary winding having a first end and a second end and providing a voltage substantially twice the determined voltage. A capacitor has two electrodes, one of the electrodes being electrically connected to ground. A diode rectifier is electrically connected between the first end of the secondary winding of the first transformer and the other electrode of the capacitor. A spark plug is electrically connected in series with a spark gap and the diode capacitor. High voltage diode means is electrically connected between the first end of the secondary winding of the second transformer and a point common to the spark gap and the spark plug.

The corona arc circuit of the second embodiment of the invention comprises a transformer having a primary winding and a secondary winding having a first end, a second end electrically connected to ground and providing a predetermined voltage. A capacitor has a first electrode electrically connected to ground and a second electrode. A first spark gap is electrically connected in series with the second electrode of the capacitor. High voltage diode means is electrically connected in series with the first end of the secondary winding of the transformer, a second spark gap and a spark plug. The second spark gap is electrically connected to a point common to the first spark gap and the high voltage diode means and a diode rectifier is electrically connected between the high voltage diode means and a point common to the first spark gap and the capacitor.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENTS

Figure 1:
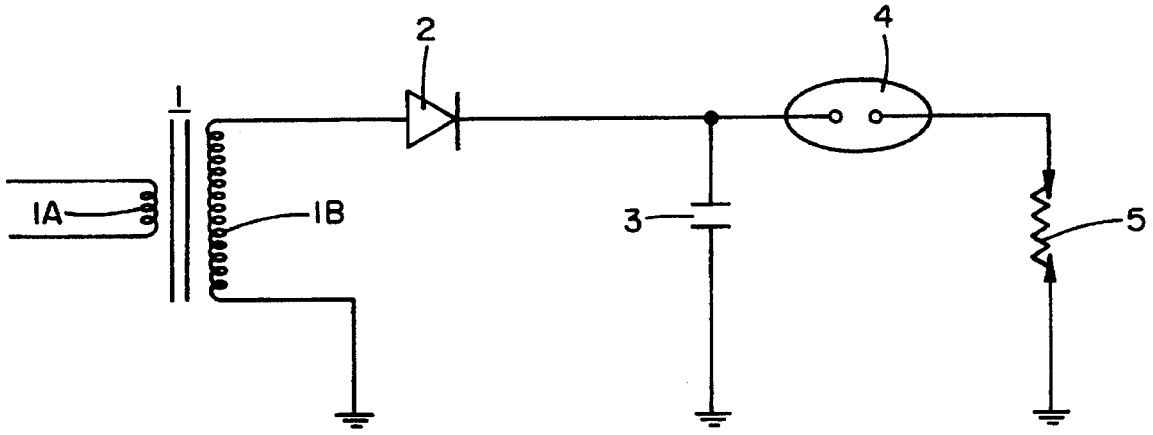
FIG. 1 PRIOR ART
FIG. 1 is a circuit diagram of a power arc circuit of the prior art.

The power arc ignitor circuit of the prior art, shown in FIG. 1, was developed to permit ignition of extremely dirty fuels. The prior art circuit of FIG. 1 was sometimes known as a high energy ignition system due to the use of sizable capacitors on the order of 6 microfarads, charged to 2000 volts and then discharged in a short time. The resulting arc is quite hot and typically has the ability to burn through contaminants and still deliver enough energy to ignite a burner.

In the prior art circuit of FIG. 1, a transformer 1 produces a 2000 RMS AC voltage with a normal 120 or 220 vac input. This voltage is rectified by a diode 2 and charges a capacitor 3. The output of the capacitor 3 is electrically connected in series with a spark gap 4, designed to short at 2000 volts, and a special concentric arc probe or special spark plug 5 which has a necessary surface resistance between the inner and outer electrode. Since there is a resistance in the special spark plug 5, the spark gap 4 is capable of realizing the voltage of the capacitor 3 as it rises to its designed 2000 volt breakdown point. When this potential is reached, the spark gap 4 shorts out and the 2000 volt potential is delivered to the special spark plug 5 itself. At that point, an arc snaps between the two electrodes of the special spark plug 5. The transformer 1 has a primary winding 1A and a secondary winding 1B.

As soon as the spark gap 4 is short-circuited, most of the stored energy of the capacitor 3 is delivered in the special spark plug 5 in about 6 microseconds. The transformer 1 is unable to keep up with the current flow, so the capacitor voltage drops to about 200 volts. At that point, the spark gap 4 ceases to conduct, the arc in the special spark plug 5 ceases, and since the input voltage is always on, the circuit then repeats itself.

Figure 2:
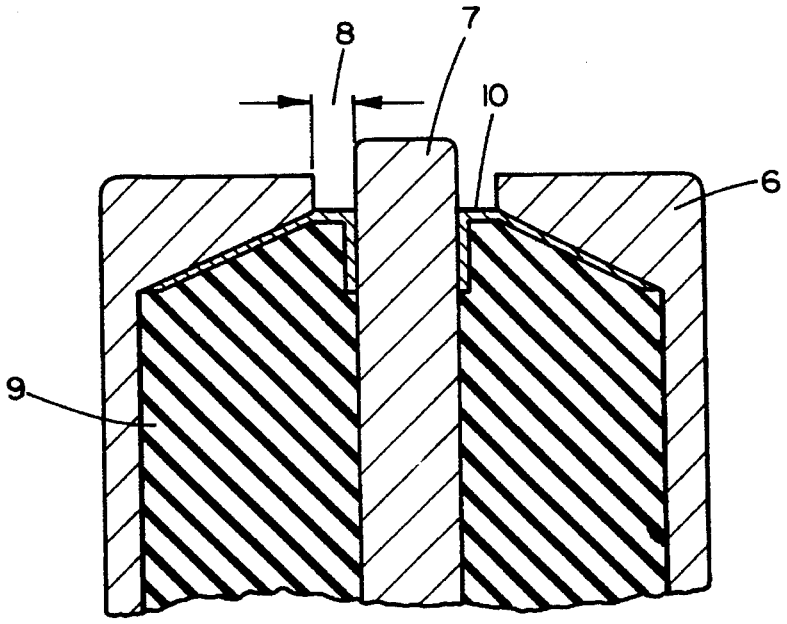
FIG. 2 PRIOR ART
FIG. 2 is a cross-sectional view, on an enlarged scale, of part of the special spark plug of the prior art as included in the circuit of FIG. 1.

A typical arc probe or special spark plug 5 is shown in FIG. 2. The outer electrode 6 is of cylindrical structure and is at ground potential and is usually constructed of stainless steel, or Inconel (TM). A rod-like center positive electrode usually comprises a more special nickel or tungsten alloy to resist electron pitting. The electrodes 6 and 7 are coaxially positioned and are spaced by a concentric radial gap 8 of about 0.040 inch.

An electrically non-conductive insulator 9 is positioned between the inner and outer electrodes 6 and 7. The insulator 9 usually comprises alumina, or some other metal oxide, or clay. The insulator 9 provides the main structural support of the device. A thin semiconductive layer 10 is provided on top of the insulator 9. The semiconductive layer 10 must be, and is, in electrical contact with both electrodes 6 and 7 and must also be thin in order to not be too conductive.

A particular aspect of the arc probe or spark plug system of the prior art is the location of the semiconductive material 10. It must be a thin coating and it must be on the same surface that supports the capacitive discharge arc. This is necessary to insure the rapid 6 microsecond discharge rate. Instead of discharging through the semiconductive material 10, the abundance of current causes the following. The current flow lifts off the surface, the space above the surface becomes ionized, the resistance of this area drops as the spark gap has already done and, finally, the current, because of the minimum resistance of the spark gap and the area above the arc probe of the prior art discharges rapidly, resulting in a hot arc.

It is the phenomenon of 12 joules of energy whereby a 6 microfarad capacitor charged to 2000 volts is discharged in a short time that the corona arc circuit of the invention preserves. However, the corona arc circuit of the invention replaces the need for the special semiconductive coating 10. Instead of actually having a semiconductive material grounding the spark gap, an effective low resistance is created at the spark plug by creating a "pre" spark at the spark plug by a second transformer. This spark has the same two repercussions as a resistive coating. That is, it grounds the spark gap and it directs the energy of the primary arc from the capacitor across the surface of the spark plug. The hot discharge phenomenon of the capacitor short-circuit remains the same.

Figure 3:
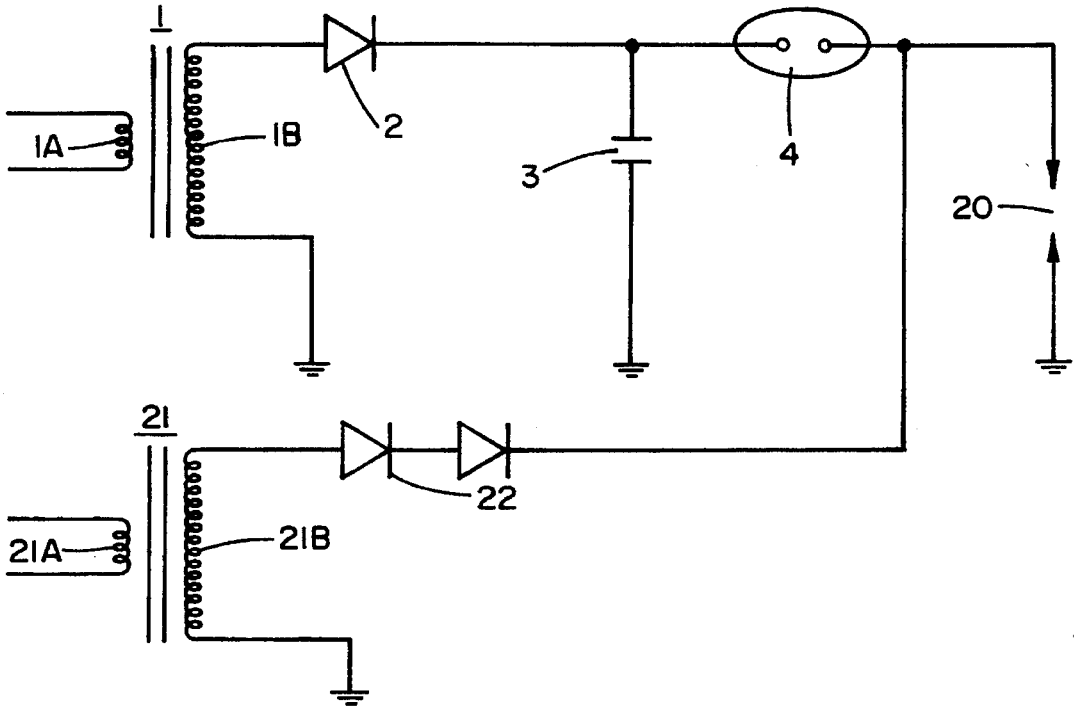
FIG. 3 is a circuit diagram of a first embodiment of the corona arc circuit of the invention.

In the first embodiment of the invention, shown in FIG. 3, the low resistance arc probe or special spark plug 5 of the prior art circuit of FIG. 1 is replaced by a normal, usual or standard spark plug 20 with a solid ceramic between the electrodes and no resistive coating. The circuit of FIG. 3 has a normal low current 5000 volt ignition transformer 21 and a high voltage diode 22 which rectifies the 5000 volt AC potential into a 5000 plus volt DC potential.

Figure 4:
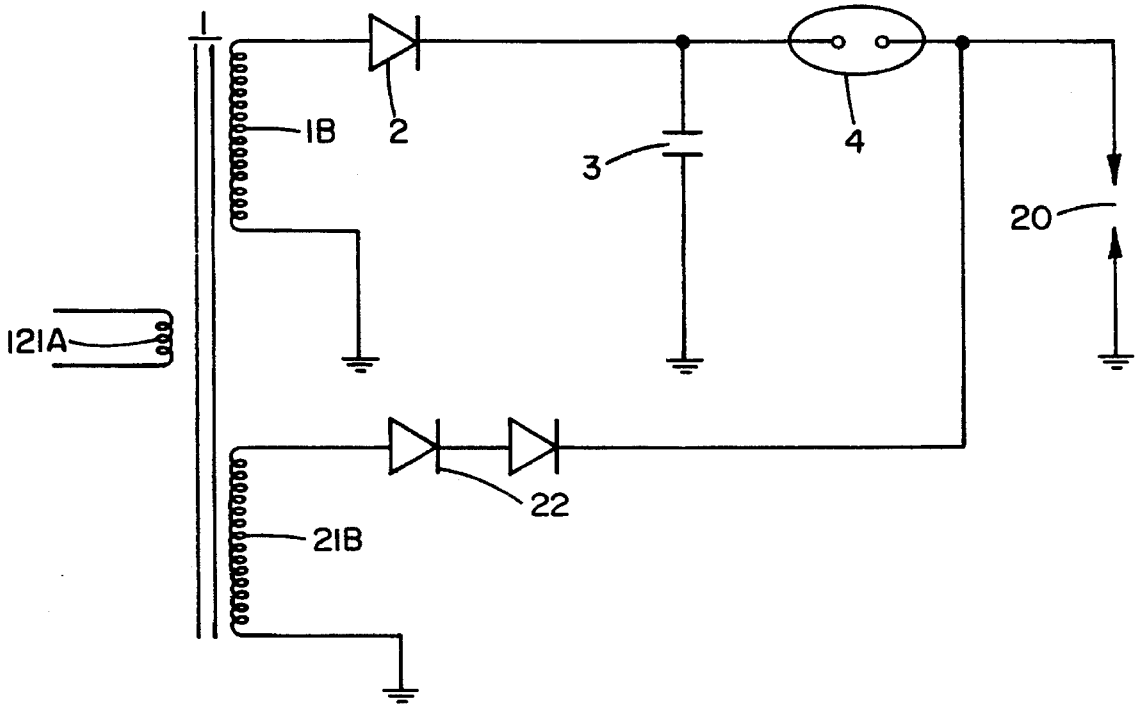
FIG. 4 is a circuit diagram of a first modification of the first embodiment of FIG. 3.

The first modification of FIG. 4 is the same circuit as that of FIG. 3 with the exception that both the 2000 and 5000 volt windings or coils 1B and 21B, respectively, are combined on one transformer core with a common primary winding 121A. Preferably, the transformer 21 should be structured so that it provides a little greater than 5000 volts at the secondary winding 21B.

In the initial ON state of the circuits of FIGS. 3 and 4, the 2000 volt winding or coil 1B charges the capacitor 3 and the 5000 volt winding or coil 21B produces a DC current across the normal spark plug 20. Since the current actually flows through the spark plug 20, the air is ionized, so that the actual voltage drop between the center electrode and the outside electrode, which is at ground potential, maintains itself at a low voltage level on the order of a few hundred volts.

The operation of the remainder of the circuits of FIGS. 3 and 4 follows a similar sequence to the prior art circuit of FIG. 1. The spark gap 4 waits until it sees a 2000 volt potential. This occurs when the capacitor 3 is charged to 2000 volts plus the relatively small voltage drop across the spark plug 20. The spark gap 4 then shorts out and conducts to ground, following the electrical path already established at the spark plug 20 by the spark of the 5000 volt transformer secondary winding 21B, that is, on the surface of said spark plug. Both of these two effects are equivalent to the original spark phenomenon in the prior art circuit of FIG. 1 which uses the resistive coated arc probe or spark plug.

The completion of the discharge cycle is the same in the circuits of FIGS. 3 and 4 as in the prior art circuit of FIG. 1. With little resistance to the current flow and no conducting path other than the gap between its electrodes, the capacitor 3 rapidly discharges and the current again is limited by the nature of the 2000 volt secondary winding or coil 1B. Furthermore, the circuit voltage drops, the spark gap 4 cuts off, and at last, the cycle starts anew, that is, the capacitor 3 proceeds to recharge.

Throughout the aforedescribed cycle, the circuit path between the 5000 volt secondary winding or coil 21B, the high voltage diode 22 and the spark plug 20 is uninterrupted. Thus, even if there are different current pulsations occurring at the spark plug 20, because of the primary 2000 volt winding or coil 1B circuit, the secondary 5000 volt winding or coil 21B current, because there is nothing to oppose it, always remains reasonably steady and at its relatively low voltage.

Figure 5:
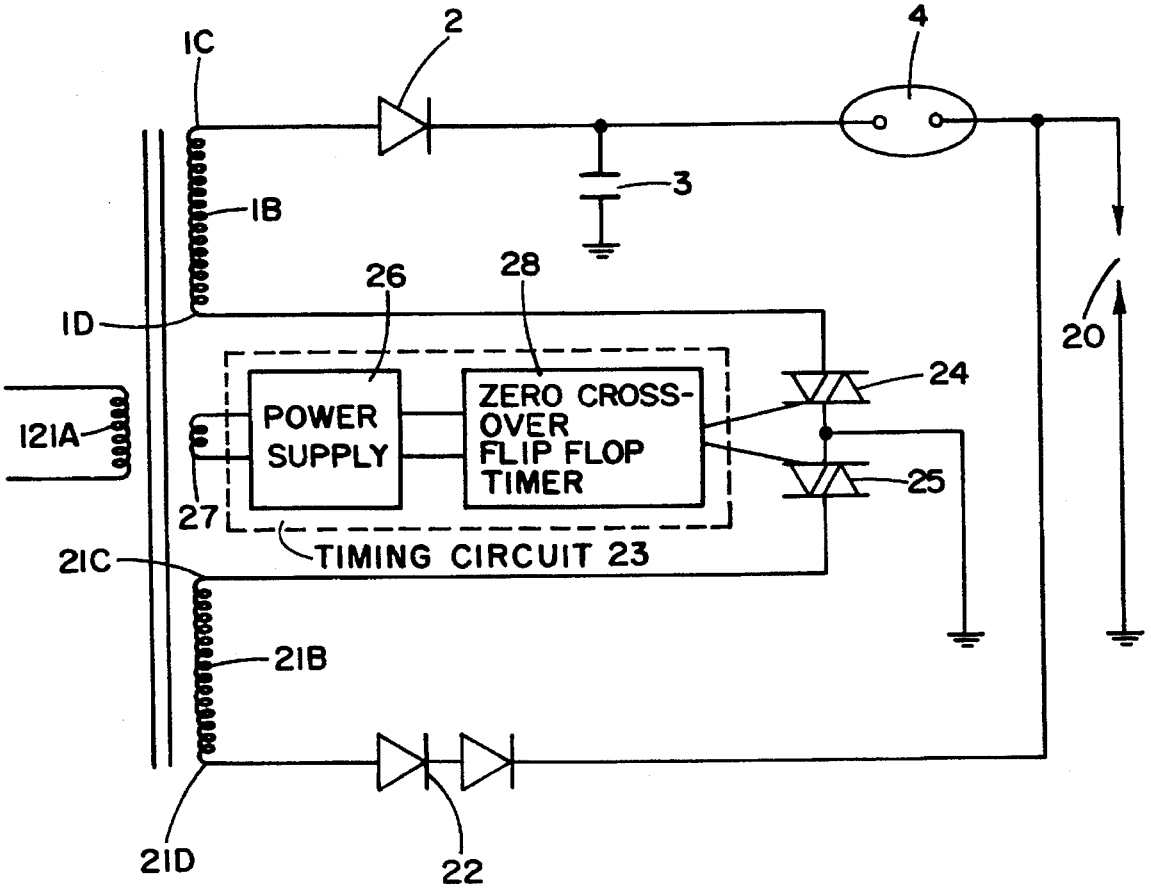
FIG. 5 is a circuit diagram of a second modification of the first embodiment of FIG. 3.

The second modification of FIG. 5, which provides better control than the aforedescribed circuits, is the same circuit as that of FIG. 4, except for the addition of a precise timing circuit 23 to the circuit of FIG. 5. The hereinbefore described circuits rely on carefully selected components with natural limitations to create a relatively inexpensive power pack. If it is determined that more durable components are warranted, then more precise timing control over the charging and discharging occurrences would be required. The circuit of FIG. 5 illustrates how this could be done. The secondary winding 1B has a first end 1C and a second end 1D and the secondary winding 21B has a first end 21C and a second end 21D. A triac driver 24 is electrically connected to the second end 1D of the secondary winding 1B and a triac driver 25 is electrically connected to the second end 21D of the secondary winding 21B. The triacs 24 and 25 are connected to each other and are switched ON by the timing circuit 23, which functions as a dual timing circuit. The triacs 24 and 25 naturally turn off when the ON signal is removed and the applied voltage crosses zero. The timing circuit includes a power source 26, a small power supply winding 27 and a modern zero cross-over flip flop timer 28. A typical operational cycle would be that when the high energy circuit is charging, the trigger circuit is off and when the trigger comes on the charging goes off.

Figure 6:
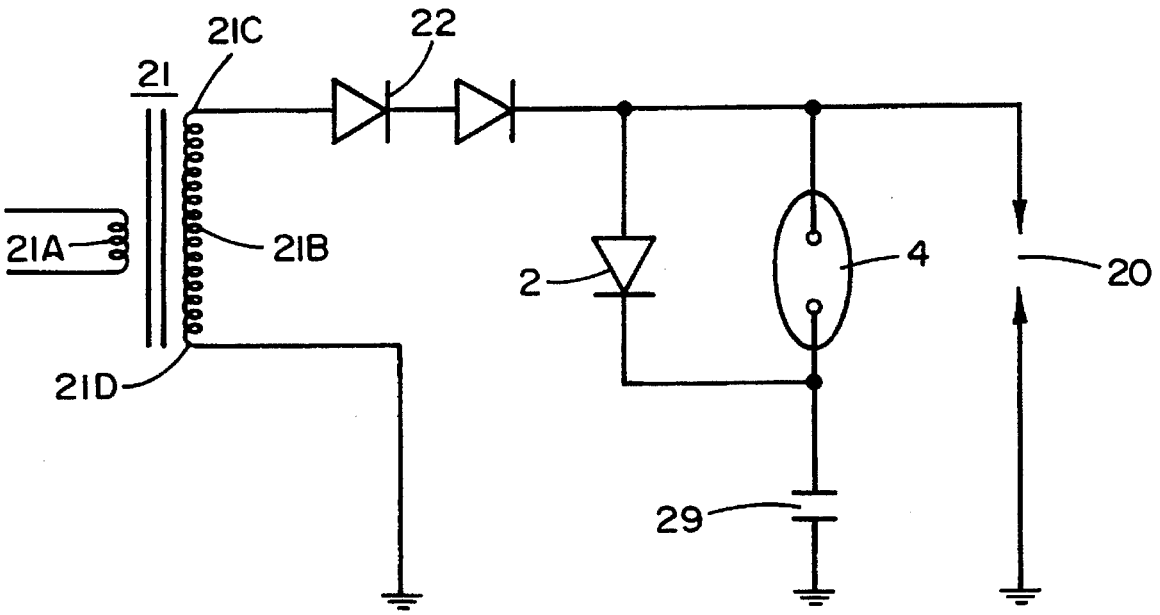
FIG. 6 is a circuit diagram of a second embodiment of the corona arc circuit of the invention.
Figure 7:
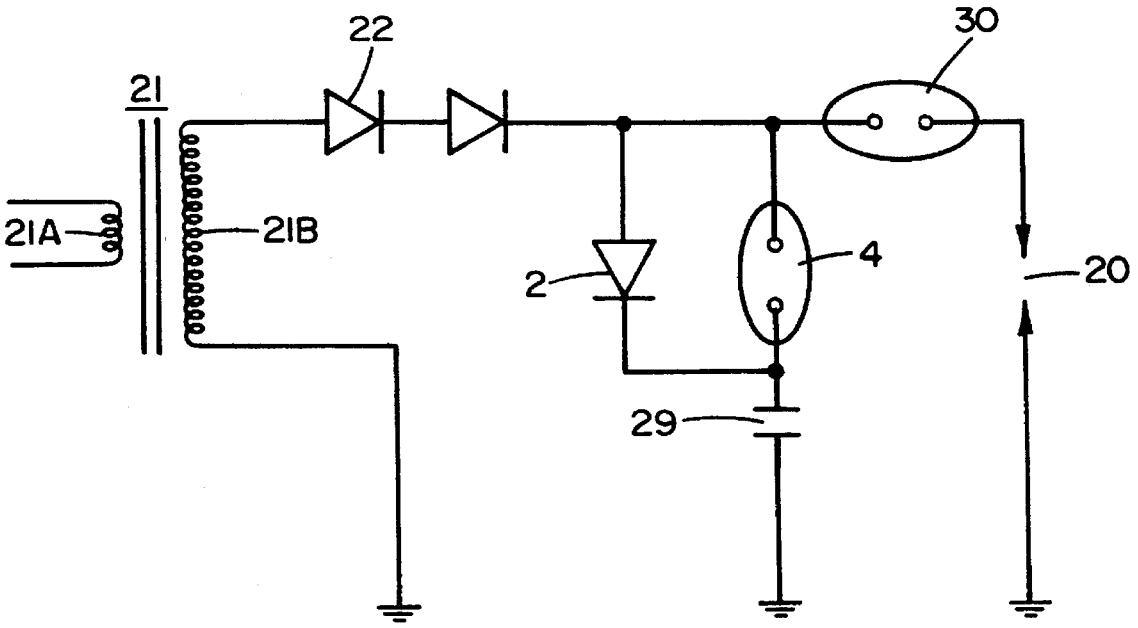
FIG. 7 is a circuit diagram of a modification of the second embodiment of FIG. 6.

The circuits of each of FIGS. 6 and 7, which disclose the second embodiment of the invention, utilize only a single 5000 volt transformer. This provides a less expensive, lower capacity unit. Significantly, although they are not the same circuit, both the single winding circuits of FIGS. 6 and 7 produce a spark gap breakdown by virtue of a pre-spark event. This is the basic premise of the aforedescribed fundamental corona arc circuits.

FIG. 6 shows a variation of the circuit with a smaller joule rating. In FIG. 6, the dual voltage source is replaced by the single high voltage secondary winding 21B. However, the same phenomenon occurs. The capacitor 3 is charged to 2000 volts and the resistive coating of the special spark plug 5 of the prior art is replaced by a 5000 volt DC arc. Current, rectified by the high voltage diode 22 bypasses the spark gap 4 through the second diode 2 and charges the capacitor 29. The capacitance of the capacitor 29 is smaller than that of the capacitor 3 and is approximately 1.0 microfarad. When the capacitor 29 is charged, the voltage potential of the transformer 21 is high enough to jump across the spark plug 20. At that point, the spark gap 4, as before, sees ground potential and shorts out. The capacitor then rapidly discharges in a short time duration, producing a hot arc.

The circuit of FIG. 6 is designed to operate with dirty or polluted fuels, so it functions well if the spark plug 20 is the open type, or is not too contaminated. If the fuel is dirty or polluted, too many contaminants could cause a dual current path; one into the capacitor 29 via the diode 2 and the other across a fouled spark plug 20 which could have a low resistance due to buildups. In such a case, the voltage potential developed across the capacitor 29 could always be less than the 2000 volt spark gap 4 and, as a result, said spark gap might never break down and said capacitor would then never discharge. The circuit of the modification of FIG. 7 addresses this situation.

The circuit of FIG. 7, which is a modification of the second embodiment of the invention shown in FIG. 6, is the same as FIG. 6, except that a second spark gap 30 is added to the circuit of FIG. 7 to circumvent the dual path problem. In FIG. 7, the second spark gap 30 forces the correct charge to be built up on the capacitor 29 regardless of shorting contaminants of the spark plug 20. When the capacitor 29 is charged, the transformer 21 has just enough energy to jump both the second spark gap 30 and the gap in, the spark plug 20. When this occurs, the spark gap 4 sees ground potential as before and the capacitor 29 is short-circuited to ground, thereby producing a hot arc.

Although shown and described in what are believed to be the most practical and preferred embodiments, it is apparent that departures from the specific method and design described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

I claim:

1. A corona arc circuit comprising:

an electrical power source having means to provide a first determined voltage and a second voltage substantially twice the first determined voltage;

rectifier means connected to said means to receive said first determined voltage;

a capacitor connected to said rectifier means for storing a charge of the determined voltage therefrom;

a spark gap having a first side and a second side with the first side connected to said capacitor to receive the stored charge therefrom and operate to conduct same at a preselected breakdown voltage;

a spark plug connected to the second side of said spark gap to provide an ignition arc from the stored charge above the spark gap breakdown voltage; and high voltage diode means connected to said power source to receive said second voltage, said high voltage diode means also being connected between said spark plug and said second side of said spark gap whereby said second voltage that is substantially twice the first determined voltage provides a current flow at the spark plug for ionizing the area between the spark plug center electrode and the outer electrode that is at ground potential to maintain a current path at a low voltage potential allowing said second side of said spark gap to see ground potential to maintain that the voltage operating said spark gap will be at its predetermined breakdown voltage and to insure that the discharge of said capacitor through the spark gap occurs through said spark plug as a high current arc along the preestablished current path to ground.

2. A corona arc circuit for providing the ground path for the discharge side of a spark gap controlled discharge circuit, said corona arc circuit comprising:

a first transformer having a primary winding and a secondary winding having a first end and a second end, said second end being connected to ground potential, providing a determined voltage at said first end;

a second transformer having a primary winding and a secondary winding having a first end and a second end, said second end being connected to ground potential, said secondary winding providing a voltage substantially twice said determined voltage;

a capacitor having two electrodes, one of said electrodes being electrically connected to ground;

a diode rectifier electrically connected between the first end of said secondary winding of said first transformer and the other electrode of said capacitor;

a spark gap having a first side connected to said diode rectifier and the other electrode of the capacitor and a second side;

a spark plug having two electrodes, one of said electrodes being electrically connected with the second side of said spark gap and the other of said electrodes being connected to ground; and high voltage diode means electrically connected between the first end of said secondary winding of said second transformer and a point between said second side of said spark gap and said one of said electrodes of said spark plug whereby the secondary winding of said transformer produces DC current by way of a spark between the two electrodes of said spark plug whereby the current path of the spark plug side of the spark gap is reduced to substantially ground potential to insure that the discharge of said capacitor is delayed until the breakdown voltage of the spark gap is reached and that this spark concurrently directs the discharge of the capacitor along its current path through said spark gap to ground after the breakdown of the spark gap.

* * * * *

UNITED STATES PATENT AND TRADEMARK OFFICE

CERTIFICATE OF CORRECTION

PATENT NO. : 5,471,362

DATED : November 28, 1995

INVENTOR(S) : Thomas L. Cowan

It is certified that error appears in the above-indentified patent and that said Letters Patent is hereby corrected as shown below:

On the Title Page, Section [19]: "Gowan"

should read --Cowan--

On the Title Page, Section [75]: "Gowan"

should read --Cowan--

Signed and Sealed this

Twenty-third Day of April, 1996

*Attest:*

*Attesting Officer*

BRUCE LEHMAN

*Commissioner of Patents and Trademarks*